US005698946A

United States Patent [19]

Merker

[11] Patent Number: 5,698,946

[45] Date of Patent: Dec. 16, 1997

[54] ELECTRIC LAMP HAVING A PROTECTIVE SKIN ON END PORTIONS OF THE CURRENT CONDUCTORS

[75] Inventor: Heinz B. Merker, Julich, Germany

[73] Assignee: U.S. Philips Corporation, New York, N.Y.

[21] Appl. No.: 445,983

[22] Filed: May 22, 1995

Related U.S. Application Data

[63] Continuation of Ser. No. 60,779, May 12, 1993, abandoned.

[30] Foreign Application Priority Data

Jun. 5, 1992 [EP] European Pat. Off. ..... 92201637

[51] Int. Cl.[6] ..... H01J 17/18; H01J 61/36

[52] U.S. Cl. ..... 313/623; 313/331; 313/332; 427/126.1; 445/58

[58] Field of Search ..... 313/623, 331, 313/332; 427/126.1, 250; 445/58

[56] References Cited

U.S. PATENT DOCUMENTS 3,012,167 12/1961 Poole .
4,015,165 3/1977 Hardies .
4,101,798 7/1978 Notelteirs et al. .
4,429,011 1/1984 Kim et al. .
4,603,056 7/1986 MacKinnon et al. .
4,701,381 10/1987 Jack .
5,021,711 6/1991 Madden et al. ..... 313/623

FOREIGN PATENT DOCUMENTS 472100 2/1992 European Pat. Off. ..... 313/623

*Primary Examiner*—Sandra L. O'Shea
*Assistant Examiner*—Matthew J. Esserman
*Attorney, Agent, or Firm*—Walter M. Egbert, III

[57] ABSTRACT

The electric lamp (1) has a lamp vessel (2), wherein an electric element (3) is accommodated. This element is connected to current conductors (4). Molybdenum end portions (5) of the current conductors extend outside the lamp vessel and have a skin of molybdenum nitride as a protection against oxidation.

2 Claims, 1 Drawing Sheet

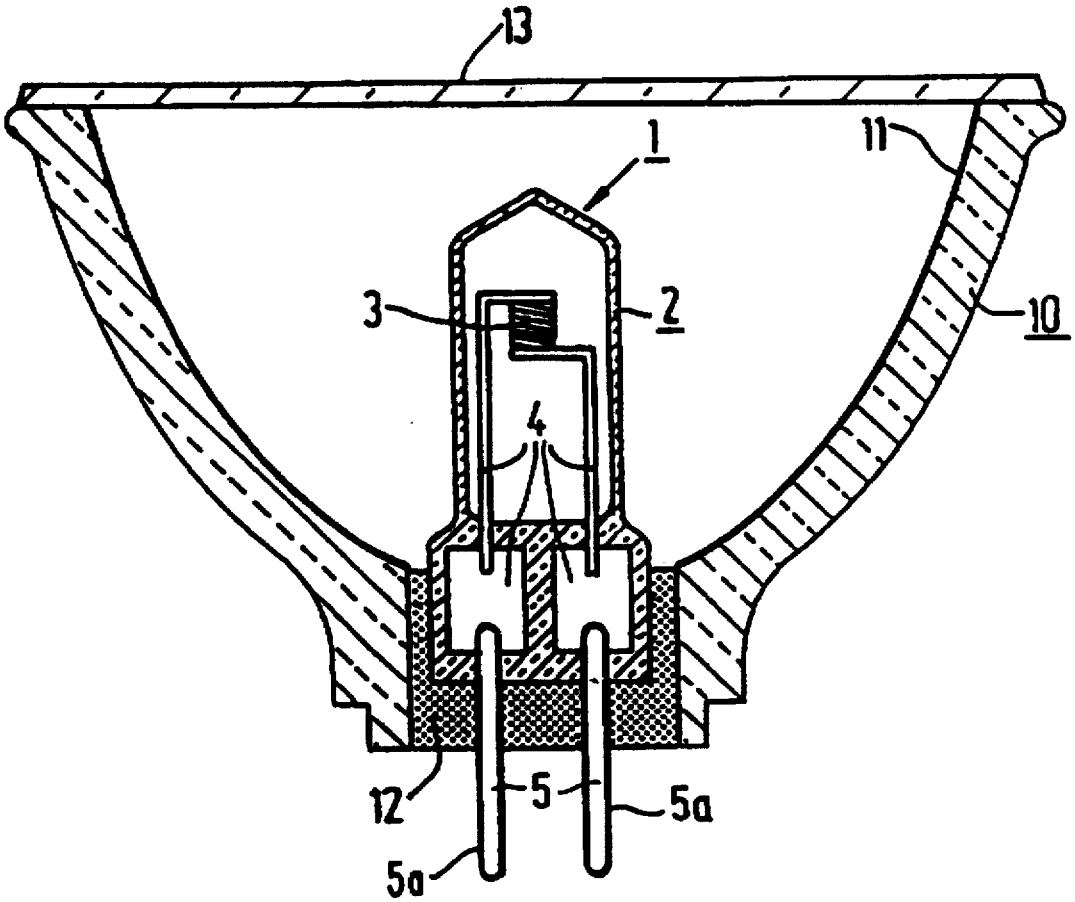
13
1
11
3
2
10
4
12
5
5a
5a

ELECTRIC LAMP HAVING A PROTECTIVE SKIN ON END PORTIONS OF THE CURRENT CONDUCTORS

This is a continuation of application Ser. No. 08/060,779, filed May 12, 1993, now abandoned.

BACKGROUND OF THE INVENTION

The invention relates to an electric lamp comprising a glass lamp vessel which is closed in a vacuumtight manner and in which an electric element is arranged, current conductors connected to the electric element and each having an end portion of molybdenum projecting from the lamp vessel, which end portion protects against oxidation.

Such an electric lamp is known from U.S. Pat. No. 4,015,165.

Current conductors with molybdenum end portions are often used in electric lamps because this metal is resistant to high temperatures and because this metal combines well with hard glasses due to its coefficient of expansion and deviates relatively little from quartz glass, i.e. glass having an $SiO_2$ content of at least 95% by weight.

A disadvantage of molybdenum, however, is that it oxidizes readily at room temperature, such that the possibility of a good electrical contact with, for example, the connection terminals of a lampholder is lost.

According to the above-mentioned Patent, the end portions are enclosed and fixed in metal bushes of oxidation-resistant metal. The bushes and their mounting, however, increase the cost price of the lamp.

According to the cited Patent, it was already known to use end portions having a coating of a noble metal such as, for example, nickel, platinum, palladium, gold. Not only are such coatings expensive, but they are also capable of reacting with molybdenum and forming alloys which melt at lower temperatures than those which are possibly used during the manufacture of lamps.

U.S. Pat. No. 3,012,167 discloses the use of molybdenum end portions with such a platinum coating.

SUMMARY OF THE INVENTION

It is an object of the invention to provide an electric lamp of the kind described in the opening paragraph having current conductors whose end portions have a readily realizable protection against oxidation.

According to the invention, this object is achieved in that these end portions have a skin of molybdenum nitride.

The molybdenum nitride skin is not only easy to realize, but the skin is also effective against oxidation, not only during storage at room temperature but also at elevated temperature, for example, up to approximately 200° C. It is also found that no oxidation has taken place after immersion during 3 weeks in a 10% by weight sodium chloride solution, in which molybdenum itself is coloured blue after 1 day owing to oxidation.

The nitride skin may be readily obtained in that molybdenum is exposed to ammonia gas at a raised temperature. A treatment of several minutes, for example, 15–20 minutes at 600°–850° C. and 1 bar already provides an amply sufficient protection. The treated molybdenum may be cooled down in the same environment or in an inert protective gas such as, for example, nitrogen.

The molybdenum treated in this way was heated to 2400° C. in a carbon crucible and the nitride was dissociated, which renders it possible to demonstrate unequivocally by a heat-conductivity measurement in an "ONMat Ströhlein" apparatus that molybdenum pins of 700 μm thickness with a nitride skin obtained as above contain approximately 300 ppm nitrogen.

In spite of the protection against oxidation afforded by the molybdenum nitride skin, the protected end portion can be processed in a conventional manner, for example, by welding it to a metal foil, for example, a molybdenum foil on which a vacuumtight seal of the lamp vessel is realized. A good electrical connection can be realized on the protected end portion with contacts of a lampholder. The electrical resistance of the connection is only a few mΩ greater than in the case of platinum or platinum-plated end portions.

The electric element of the lamp may be a pair of electrodes in an ionizable gas or alternatively an incandescent body, for example, in an inert gas containing a halogen. The lamp vessel may have one or more seals through which a current conductor is passed to the exterior. The lamp vessel, for example, made of quartz glass or hard glass, may be united with a reflector body so as to form a lamp/reflector unit.

BRIEF DESCRIPTION OF THE DRAWING FIGURES

An embodiment of the electric lamp according to the invention is shown in longitudinal section in the drawing.

DESCRIPTION OF THE INVENTION

In the FIGURE, the electric lamp 1 has a glass lamp vessel 2 closed in a vacuumtight manner and accommodating an electric dement 3. Current conductors 4, each having an end portion 5 of molybdenum projecting from the lamp vessel, are connected to the electric element. The end portion has means 6 for protecting it from oxidation. For this purpose, the end portion 5 has a skin **5*a*** of molybdenum nitride.

In the FIGURE, the current conductors 4 comprise legs of the incandescent body and molybdenum foils connected thereto by means of welds. The end portions 5 with molybdenum skin **5*a* which act as contact pins for the lamp, are also welded to the foils. The lamp 1 is fixed with cement 12 in a reflector body 10 which comprises a mirroring surface 11 and a closing plate 13**.

The shown lamp/reflector unit may be used, for example, for accent lighting, for projection purposes, or for photo, video or film recordings.

I claim:

1. An electric lamp comprising a glass lamp vessel which is closed in a vacuumtight manner and in which an electric element is arranged, current conductors connected to the electric element, each of said current conductors having a front portion disposed within the lamp vessel and an end portion that extends from said lamp vessel, said end portion being of molybdenum and including at least a portion thereof protected against oxidation by a skin of molybdenum nitride.

2. An electric lamp comprising a glass lamp vessel which is closed in a vacuumtight manner and in which an electric element is arranged, current conductors connected to the electric element, each of said current conductors having a front portion disposed within the lamp vessel and an end portion that extends from said lamp vessel, said end portion being of molybdenum and including at least a portion for electrical contact with a lampholder and protected against oxidation by a skin of molybdenum nitride.

* * * * *